US006013612A

United States Patent [19]

Saito et al.

[11] Patent Number: 6,013,612

[45] Date of Patent: *Jan. 11, 2000

[54] CLEANING AGENT COMPOSITION

[75] Inventors: Makoto Saito; Tohru Yamamoto; Sumio Soya, all of Kawasaki, Japan

[73] Assignee: Showa Denko K.K., Tokyo, Japan

[ * ] Notice: This patent is subject to a terminal disclaimer.

[21] Appl. No.: 09/283,761

[22] Filed: Apr. 2, 1999

Related U.S. Application Data

[63] Continuation of application No. 08/956,049, Oct. 22, 1997, Pat. No. 5,929,006.

[51] Int. Cl.[7] ..... C11D 1/83; C11D 3/26; C11D 7/32

[52] U.S. Cl. ..... 510/185; 510/191; 510/199; 510/200; 510/214; 510/221; 510/229; 510/235; 510/238; 510/336; 510/340; 510/351; 510/356; 510/421; 510/361; 510/422; 510/426; 510/427; 510/434; 510/480; 510/488

[58] Field of Search ..... 510/185, 191, 510/199, 200, 214, 221, 229, 235, 238, 336, 340, 351, 356, 361, 421, 422, 426, 427, 434, 480, 488

[56] References Cited

U.S. PATENT DOCUMENTS 5,695,679 12/1997 Christie et al. ..... 252/186.26
5,755,992 5/1998 Jeffrey et al. ..... 252/186.38

FOREIGN PATENT DOCUMENTS 1 4211713 10/1993 Germany .
1 4240695 6/1994 Germany .
5681399 7/1981 Japan .

*Primary Examiner*—Mark Kopec
*Assistant Examiner*—Gregory R. Delcotto
*Attorney, Agent, or Firm*—Sughrue, Mion, Zinn, Macpeak & Seas, PLLC

[57] ABSTRACT

A cleaning agent composition which contains as major components an aminodicarboxylic acid N,N-diacetic acid salt, (particularly aspartic acid N,N-diacetic acid salt or glutamic acid N,N-diacetic acid salt) and a glycolic acid salt and of which a cleaning liquid has pH 8.5 or higher. Preferably, the composition further contains anionic surfactant and/or nonionic surfactant or an alkali metal hydroxide.

The cleaning agent composition of the present invention has excellent cleaning effect and biodegradability and can be used advantageously as domestic, medical, and industrial cleaning agents.

14 Claims, 1 Drawing Sheet

CLEANING AGENT COMPOSITION

This application is a continuation of U.S. application Ser. No. 08/956,049, filed on Oct. 22, 1997, now U.S. Pat. No. 5,929,006, the entire content of which is herein incorporated by reference.

FIELD OF THE INVENTION

The present invention relates to a novel cleaning agent composition and more particularly to a cleaning agent composition which is used in home or for automobiles.

PRIOR ART AND PROBLEMS THEREOF

Recently, influences of various detergents on environmental pollution are being discussed extensively and there is a trend that the components of detergents are replaced by those which have less adverse effects on environment. For example, the problems of enrichment of rivers, lakes, or ponds with sodium tripolyphosphate used as a builder in detergents for domestic use have been coped with by the replacement of sodium tripolyphosphate by zeolite or sodium carbonate. In the case of surfactants, branched alkylbenzenesulfonic acid salts have been replaced by straight chain alkylbenzenesulfonic acid salts which are highly biodegradable or by polyoxyethylene ether sulfates or higher alcohol ethoxylate which have much higher biodegradability.

However, detergents for domestic use often contain chelating agents representative example of which is ethylenediaminetetraacetic acid salt (hereafter, EDTA) in order to increase their performance and, hence, there has been the increasing fear that EDTA adversely influences on environment due to its failure to be biodegraded. Development of various chelating agents as substitutes for EDTA is still under way. DE-A4211713 discloses a method of synthesizing aminodicarboxylic acid N,N-diacetic acid and its potential utility as a chelating agent. However, this has not reached a practically acceptable level. Also, De-A4240695 discloses use of iminodiacetic acid derivatives in high alkali content cleaning agents for beverages and food industries. However, use of this compound by itself does not provide a sufficient performance which is comparable to the performance of EDTA, and, hence, it needs to be used in much more amounts in order to obtain the performance as high as that of EDTA. This approach is uneconomical.

Japanese Patent Application Kokai No. 56-81399 proposes phosphorus-free detergent compositions containing glutamic acid N,N-diacetic acid, an anionic surfactant and/or nonionic surfactant, an imidosulfate and palmitic acid as a detergent for cloths. However, this proposal relates to a very limited composition including specified compounds. Therefore, a formulation is desired which can efficiently exhibit its function as a chelating agent or a builder in various detergent systems containing surfactants.

DISCLOSURE OF THE INVENTION

As a result of intensive investigation by the present inventors with view to solving the above-described problems, it has now been found that the cleaning agent composition containing as major components A) an aminodicarboxylic acid N,N-diacetic acid salt, and B) a glycolic acid salt has a cleaning power which is superior to each of the single components due to their synergistic effect therebetween, which is the same or more potent than conventional detergents containing EDTA salts or those containing other builders, and which is excellent in biodegradability. The present invention has been completed based on this discovery.

Therefore, the present invention provides a cleaning agent composition, particularly a weakly alkaline or alkaline detergent composition, containing A) an aminodicarboxylic acid N,N-diacetic acid salt, and B) a glycolic acid salt.

Further, the present invention provides a cleaning agent composition, further containing C) an anionic surfactant and/or nonionic surfactant, which is useful over a wide range and highly effective on various stains or dirt.

Still further, the present invention provides a weakly alkaline or alkaline cleaning agent composition containing A) and B) which further contains D) an alkali metal hydroxide and which is useful over a wide range and highly effective on various stains or dirt.

DETAILED DESCRIPTION OF THE INVENTION

The cleaning agent composition of the present invention basically contains A) an aminodicarboxylic acid N,N-diacetic acid salt and B) a glycolic acid salt.

A) The aminodicarboxylic acid N,N-diacetic acid salt is a salt of an aminodicarboxylic acid of which two hydrogen atoms of the $NH_2$ group is substituted with two acetate groups. Preferred is compound represented by the following general formula (I)

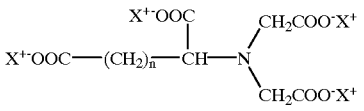

(I)

wherein each $X^+$ is independently an alkali metal ion, or an ammonium ion, and n is an integer of from 0 to 5. Particularly preferred are aspartic acid N,N-diacetic acid salts in the case of n=1 and glutamic acid N,N-diacetic acid salts in the case of n=2. As a salt, preferred is sodium salt.

B) The glycolic acid salt is a compound represented by the following general formula (II)

$$HOCH_2COO^-X^+ \quad \text{(II)}$$

wherein $X^+$ is an alkali metal ion, or an ammonium ion, preferably the same meaning as the X in the general formula (I) for the aminodicarboxylic acid N,N-diacetic acid salt described above.

The aminodicarboxylic acid N,N-diacetic acid salts exhibit a chelating capability and captures (sequesters) metal ions such as $Ca^{2+}$, $Mg^{2+}$ and the like and retains the metal in water in a stable manner. When a surfactant coexists, the aminodicarboxylic acid N,N-diacetic acid salts also serves to assist their effects, that is, they play the role of a builder.

The glycolic acid salt has an effect of further stabilizing the chelate complex in water. When a surfactant coexists, the glycolic acid salt is considered to exhibit an activity as a builder.

The glycolic acid salt is used in amounts of preferably from 0.01 to 0.6 parts by weight, more preferably from 0.025 to 0.5 parts by weight, and most preferably from 0.05 to 0.2 parts by weight par 1 part by weight of the aminodicarboxylic acid N,N-diacetic acid salt. If the amount of the glycolic acid salt is less than 0.01 part by weight no cleaning effect can be exhibited while an amount of the glycolic acid salt more than 0.6 parts by weight gives rise to no change in effect. Although it may be added separately from the aminodicarboxylic acid N,N-diacetic acid salts, the glycolic acid salt can also be obtained as a by-product when aminodicarboxylic acid N,N-diacetic acid salts are produced, for example, from sodium cyanide and formalin and, hence, the reaction product can be used in the cleaning agent composition with adjusting the contents of minor components, for example, by addition of such components. For adjusting the contents of the components within the preferred range used in the present invention, there can be utilized a method for controlling the amount of the by-produced glycolic acid salt.

Figure 1:
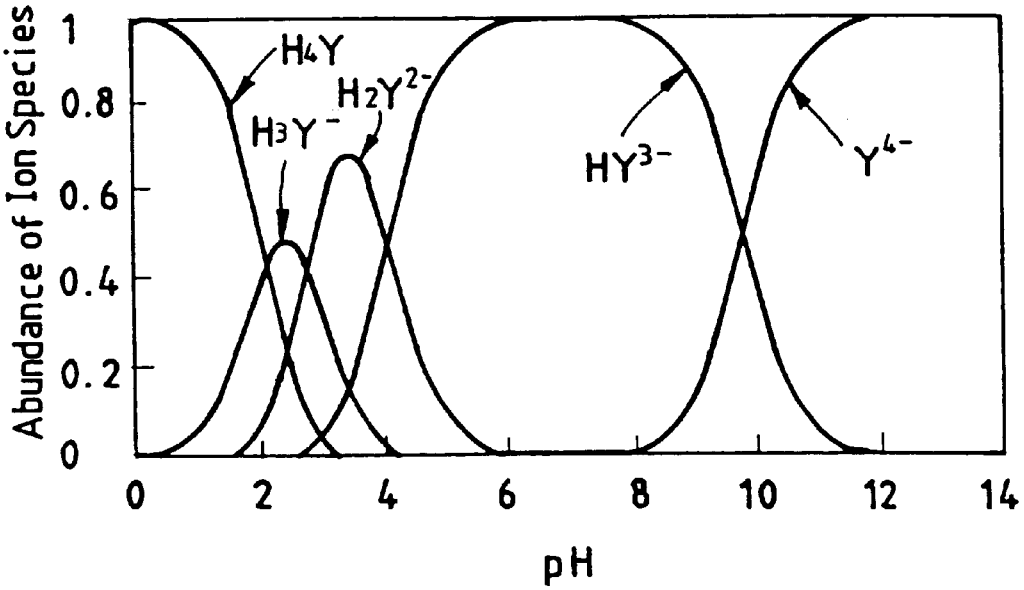
FIG. 1 is a graph illustrating the abundance of each ion species of aspartic acid N,N-diacetic acid at various pH values.
Figure 2:
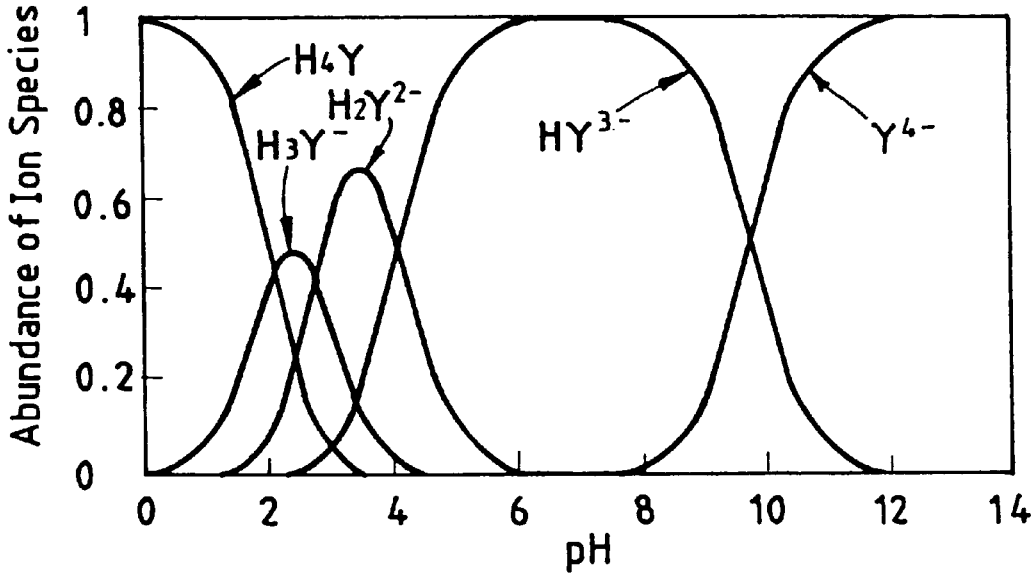
FIG. 2 is a graph illustrating the abundance of each ion species of glutamic acid N,N-diacetic acid at various pH values.

The cleaning agent composition containing A) and B) exhibits an excellent cleaning performance with the pH 8.5 or higher. This can be explained from the state of ionic dissociation at respective pH values as shown in FIGS. 1 and 2.

More specifically, the aminodicarboxylic acid N,N-diacetates are tetrabasic acid and its ionic dissociation proceeds as indicated by the Reaction Scheme 1:

Reaction Scheme 1

$$H_4Y \rightarrow H_3Y^- + H^+ \quad (a)$$

$$H_3Y^- \rightarrow H_2Y^{2-} + H^+ \quad (b)$$

$$H_2Y^{2-} \rightarrow HY^{3-} + H^+ \quad (c)$$

$$HY^{3-} \rightarrow Y^{4-} + H^+ \quad (d)$$

wherein $H_4Y$ means an aminodicarboxylic acid N,N-diacetic acid.

The above-described ionic dissociation will be explained taking glutamic acid N,N-diacetic acid as an example. With an increase in pH, the carboxylic acid shows stepwise dissociation equilibrium in the order of (3), (1) and (2) or (4).

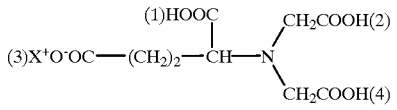

On the other hand, ligands to a metal as a chelating agent are N and —$COO^-$ (having a pair of non-shared electrons) in the molecule, and the chelating capability increases as the progress of dissociation. However, it is considered that there is the possibility that the —$COO^-$ in (3) which has a large chelating ring does not participate in the formation of a complex because comparison between the aspartic acid N,N-diacetic acid salts and glutamic acid N,N-diacetic acid salts, i.e., the aminocarboxylic acid N,N-diacetic acid salts contained in the cleaning agent composition of the present invention, indicated that the chelating capability per molecular weight did not change substantially. In other words, in the present invention, it is considered that there is formed a complex similar to those formed from nitrilotriacetic acid salts generally used as chelating agent.

The cleaning agent composition containing A) and B) may further contain C) an anionic surfactant and/or nonionic surfactant. The existence of the anionic surfactant and/or nonionic surfactant in the composition allows the cleaning agent composition to be effective on applications over a wide range.

The anionic surfactant an/or nonionic surfactant can be those used conventionally for general purposes and preferably are surfactants having excellent biodegradability. Examples of the anionic surfactant include higher fatty acid salt represented by soaps (for example, $C_{8-24}$ fatty acid alkali metal salts), various sulfuric acid esters (for example, sulfuric acid esters of $C_{6-16}$ aliphatic alcohols having one or more oxyethylene groups and sulfuric acid esters of $C_{8-13}$ alkylphenols having one or more oxyethylene groups), various sulfonic acid salts (for example, alkali metal salts of alkylbenzenesulfonic acids having one or more $C_{8-13}$ aliphatic alkyl groups and alkali metal salts of $C_{12\ 16}$ alkylsulfonic acids), sulfosuccinic acid alkali metal salts (for example $C_{12\ 16}$ alkylsulfosuccinates) and the like. Nonionic surfactants include polyethylene glycol type ones, higher alcohol ethoxylates, higher alcohol ethylene oxide adducts, and the like. These can be used singly or in combination.

The surfactants have generally known actions of wetting, penetration, emulsification, dispersing, and foaming and exhibit the effect of cleaning making the best of these actions in total. The surfactants can be used in amounts preferably 1 to 100 parts by weight, more preferably 3 to 100 parts by weight, per 1 part by weight of the aminodicarboxylic acid N,N-diacetic acid salt. If the amount of the surfactants is too small, their effect cannot be obtained sufficiently. Too much a surfactant also results in an insufficient effect of the aminodicarboxylic acid N,N-diacetic acid salt as a builder.

Therefore, a suitable cleaning agent composition contains 1 to 100 parts by weight of the anionic surfactant and/or nonionic surfactant per 1 part by weight of the aminodicarboxylic acid-N,N-diacetic acid salt and preferably 0.01 to 0.6 part by weight, and more preferably 0.025 to 0.6 part by weight of the glycolic acid salt per part of the aminodicarboxylic acid N,N-diacetic acid salt.

In the case of the cleaning agent composition containing A) to C) with pH 8.5 or higher as described above, with pH 13 or lower being preferred and pH 10 to 13 being more preferred. Though not very clear, the structure of N in the molecule at lower pH values is a salt of —$NH^+$— and thus has a decreased capability of N as a ligand to metals and at pH values no lower than 13, the N further takes the form of —N(OH)—, thus decreasing the capability as a ligand to metals, suggesting that at pH 10 to 13, the chelating capability becomes considerably high (in this regard, reference is made to $pKa_4$ values of aspartic acid N,N-diacetic acid salts and glutamic acid N,N-diacetic acid salts, each of which was 9.8 by neutralization titration). Therefore, the chelating capability is considered to be most potent in the state of the above-described formula (d) achieved at pH 10 to 13.

For adjusting pH values, it is preferred that alkali metal hydroxides be used. The alkali metal hydroxides have effects of decomposing organic substances in the dirt. The alkali metal hydroxides which can be used in the present invention include sodium hydroxide, potassium hydroxide, lithium hydroxide and the like. Usually, sodium hydroxide is used. Note that use of higher pH values may sometimes be restricted depending on the nature of the material to be cleaned. In the case of cleaning glass, for example, use of alkali metal hydroxide for a long period of time could cause corrosion by the alkali. Therefore, mineral acids or organic acids may be used to adjust the pH of the composition or there may be used pH buffers such as monoethanolamine and the like.

Alternatively, in the present invention, the cleaning agent composition containing the components A) and B) above may further contain D) an alkali metal hydroxide. The alkali metal hydroxide may be used in amounts of usually 0.1 to 40% by weight, preferably 5 to 30% by weight, based on the total composition. This cleaning agent composition preferably contains the aminodicarboxylic acid N,N-diacetic acid salt, component A), in an amount of 0.01 to 30% by weight of the composition.

In the cleaning agent composition which contains A)+B)+D) as major components, the alkali metal hydroxide D) increases the chelating ability of the component A) in alkaline pH ranges. In this case, if pH exceeds 13, the chelating ability of the component A) decreases on the contrary as described above. However, in strong alkali ranges such as the case where free alkali is contained, the alkali decomposes the organic substances in the dirt and elutes alkaline earth metals in the dirt, thus increasing the cleaning activity. Accordingly, pH 8.5 or higher will be sufficient and even on the strong alkaline range higher than pH13 is achieved a good cleaning performance.

The cleaning agent composition of the present invention as described above can contain other components which are conventionally used in cleaning agents. Examples of these components include inorganic builders; enzymes which decompose protein or fat or oil; polymeric carboxylic acids which function as a builder as well as a dispersant of precipitated $CaCO_3$ typically exemplified by copolymer of acrylic acid and maleic acid; bleach, etc. also, the cleaning agent composition of the present invention can be used for various applications as described later on by diluting with water to appropriate concentrations upon use depending on the object to be cleaned. Alternatively, it can be formulated as a diluted preparation which is diluted with water in advance so that the composition can be put on the dirty portion. In the formulation containing surfactants, it is preferred that the concentration of the surfactants be from 0.25 to 90% by weight when the composition is supposed to be diluted upon use or from 0.5 to 10% by weight when the composition is used as is.

The cleaning agent composition of the present invention is excellent in biodegradability as compared with EDTA-containing cleaning agents or exhibits cleaning effects as same as or superior to those of currently used cleaning agents containing other builders.

Utility of the cleaning agent composition of the present invention includes detergents for domestic, medical, industrial and the like uses. The cleaning agent composition of the present invention is applicable to particularly those detergents which are weakly alkaline to alkaline by the classification of liquid nature. More specifically, preferred examples of the utility of the cleaning agent composition of the present invention includes powder and liquid compositions, such as detergents for cloths, detergents for houses, e.g., flooring, walls, furniture, etc., detergents for utensils, e.g., kitchen ranges, kitchen cases, et., soaps, detergents for toilets, detergents for bath room and bath tubs, detergents for automobiles, detergents for glasses and the like.

BEST MODE FOR CARRYING OUT THE INVENTION

Hereafter, the present invention will be described in detail by examples. However, the present invention should not be construed as being limited to these examples.

EXAMPLE 1

Solubility of Ca ion was evaluated as an evaluation of cleaning power on inorganic dirt.

2.0 g of sodium stearate, reagent grade, as an anionic surfactant and 1.0 g of aspartic acid N,N-diacetic acid sodium salt (hereafter, ASDA) prepared separately by a known method, and 0.1 g of sodium glycolate, reagent grade, were weighed and charged in a 100 ml beaker to which was added 90 ml of water to dissolve the mixture completely. Then, the liquid was transferred in a 100 ml measuring flash and filled up to the indicator line. This was used as a cleaning agent composition.

The cleaning agent composition (10 ml) and 10 ml of isopropyl alcohol were charged in a 200 ml beaker and water was added thereto to make 100 ml. Then, 10% by weight sodium hydroxide was added until pH 10 was reached with monitoring pH using a pH meter. While stirring, the solution thus obtained was titrated with aqueous 0.01M calcium acetate solution, defining as a final point the point where the whole solution began to become white.

As a blank, 10 ml of isopropyl alcohol was metered and charged in a 200 ml beaker, and 10% by weight sodium hydroxide was dropped down with monitoring a pH meter to prepare a solution at pH 10, followed by titration in the same manner as described above.

From the titer P (ml) of the solution to which the cleaning agent composition (10 v %) was added and the titer Q (ml) of blank, Ca chelating capability of the cleaning agent composition at the pH concerned (pH 10, in this example) was evaluated in terms of $CaCO_3$ per g of the aminodicarboxylic acid N,N-diacetic acid salt added. Results obtained are shown in Table 1.

$$\text{Ca chelating capability (mg/g)} = f\,(P-Q)/D$$

wherein P is the titer of the test, Q is the titer of the blank, f is a factory of 0.1M calcium acetate titration water, D is the weight (g) of the chelating agent/10.

EXAMPLE 2

In a 200 ml beaker were metered and charged 10 ml of a cleaning agent composition prepared in the same manner as in Example 1, 10 ml of isopropyl alcohol, and water was added thereto to make 100 ml. Then, the solution was adjusted to pH 11 with 10% by weight sodium hydroxide with monitoring a pH meter. The solution thus obtained was titrated and chelating capability was calculated in the same manner as in Example 1. Results obtained are shown in Table 1.

EXAMPLE 3

In a 200 ml beaker were metered and charged 10 ml of a cleaning agent composition prepared in the same manner as in Example 1, 100 ml of isopropyl alcohol, and water was added thereto to make 100 ml. Then, the solution was adjusted to pH 12 with 10% by weight sodium hydroxide with monitoring a pH meter. The solution thus obtained was titrated and chelating capability was calculated in the same manner as in Example 1. Results obtained are shown in Table 1.

EXAMPLE 4

In a 200 ml beaker were metered and charged 10 ml of a cleaning agent composition prepared in the same manner as in Example 1, 10 ml of isopropyl alcohol, and water was added thereto to make 100 ml. Then, the solution was adjusted to pH 13 with 10% by weight sodium hydroxide with monitoring a pH meter. The solution thus obtained was titrated and chelating capability was calculated in the same manner as in Example 1. Results obtained are shown in Table 1.

COMPARATIVE EXAMPLE 1

In a 200 ml beaker were metered and charged 10 ml of a cleaning agent composition prepared in the same manner as in Example 1, 10 ml of isopropyl alcohol, and water was added thereto to make 100 ml. Then, the solution was adjusted to pH 14 with 10% by weight sodium hydroxide with monitoring a pH meter. The solution thus obtained was titrated and chelating capability was calculated in the same manner as in Example 1. Results obtained are shown in Table 1.

EXAMPLE 5

In a 200 ml beaker were metered and charged 10 ml of a cleaning agent composition prepared in the same manner as in Example 1, 10 ml of isopropyl alcohol, and water was added thereto to make 100 ml. Then, the solution was adjusted to pH 9 with 10% by weight sulfuric acid with monitoring a pH meter. The solution thus obtained was titrated and chelating capability was calculated in the same manner as in Example 1. Results obtained are shown in Table 1.

COMPARATIVE EXAMPLE 2

In a 200 ml beaker were metered and charged 10 ml of a cleaning agent composition prepared in the same manner as in Example 1, 10 ml of isopropyl alcohol, and water was added thereto to make 100 ml. Then, the solution was adjusted to pH 8 with 10% by weight sulfuric acid with monitoring a pH meter. The solution thus obtained was titrated and chelating capability was calculated in the same manner as in Example 1. Results obtained are shown in Table 1.

EXAMPLE 6

2.0 g of sodium stearate, reagent grade, as an anionic surfactant and 1.0 g of glutamic acid N,N-diacetic acid tetrasodium salt (hereafter, GLDA) prepared separately by a known method, and 0.1 g of sodium glycolate, reagent grade, were weighed and charged in a 100 ml beaker to which was added 90 ml of water to dissolve the mixture completely. Then, the liquid was transferred in a 100 ml measuring flask and filled up to the indicator line. This was used as a cleaning agent composition. The cleaning agent composition (10 ml) and 10 ml of isopropyl alcohol were charged in a 200 ml beaker and water was added thereto to make 100 ml. Then, the solution was adjusted to pH 10 with 10% by weight sodium hydroxide with monitoring a pH meter. The solution thus obtained was titrated and chelating capability was calculated in the same manner as in Example 1. Results obtained are shown in Table 1.

EXAMPLE 7

In a 200 ml beaker were metered and charged 10 ml of a cleaning agent composition prepared in the same manner as in Example 6, 10 ml of isopropyl alcohol, and water was added thereto to make 100 ml. Then, the solution was adjusted to pH 11 with 10% by weight sodium hydroxide with monitoring a pH meter. The solution thus obtained was titrated and chelating capability was calculated in the same manner as in Example 1. Results obtained are shown in Table 1.

EXAMPLE 8

In a 200 ml beaker were metered and charged 10 ml of a cleaning agent composition prepared in the same manner as in Example 6, 10 ml of isopropyl alcohol, and water was added thereto to make 100 ml. Then, the solution was adjusted to pH 12 with 10% by weight sodium hydroxide with monitoring a pH meter. The solution thus obtained was titrated and chelating capability was calculated in the same manner as in Example 1. Results obtained are shown in Table 1.

EXAMPLE 9

In a 200 ml beaker were metered and charged 10 ml of a cleaning agent composition prepared in the same manner as in Example 6, 10 ml of isopropyl alcohol, and water was added thereto to make 100 ml. Then, the solution was adjusted to pH 13 with 10% by weight sodium hydroxide with monitoring a pH meter. The solution thus obtained was titrated and chelating capability was calculated in the same manner as in Example 1. Results obtained are shown in Table 1.

COMPARATIVE EXAMPLE 3

In a 200 ml beaker were metered and charged 10 ml of a cleaning agent composition prepared in the same manner as in Example 6, 10 ml of isopropyl alcohol, and water was added thereto to make 100 ml. Then, the solution was adjusted to pH 14 with 10% by weight sodium hydroxide with monitoring a pH meter. The solution thus obtained was titrated and chelating capability was calculated in the same manner as in Example 1. Results obtained are shown in Table 1.

EXAMPLE 10

In a 200 ml beaker were metered and charged 10 ml of a cleaning agent composition prepared in the same manner as in Example 6, 10 ml of isopropyl alcohol, and water was added thereto to make 100 ml. Then, the solution was adjusted to pH 9 with 10% by weight sulfuric acid with monitoring a pH meter. The solution thus obtained was titrated and chelating capability was calculated in the same manner as in Example 1. Results obtained are shown in Table 1.

COMPARATIVE EXAMPLE 4

In a 200 ml beaker were metered and charged 10 ml of a cleaning agent composition prepared in the same manner as in Example 6, 10 ml of isopropyl alcohol, and water was added thereto to make 100 ml. Then, the solution was adjusted to pH 8 with 10% by weight sulfuric acid with monitoring a pH meter. The solution thus obtained was titrated and chelating capability was calculated in the same manner as in Example 1. Results obtained are shown in Table 1.

COMPARATIVE EXAMPLE 5

2.0 g of sodium stearate, reagent grade, as an anionic surfactant and 1.0 g as pure content of EDTA tetrasodium salt, reagent grade, were weighed and charged in a 100 ml beaker to which was added 90 ml of water to dissolve the mixture completely. Then, the liquid was transferred in a 100 ml measuring flask and filled up to the indicator line. This was used as a cleaning agent composition. The cleaning agent composition (10 ml) and 10 ml is isopropyl alcohol were charged in a 200 ml beaker and water was added thereto to make 100 ml. Then, the solution was adjusted to pH 10 with 10% by weight sodium hydroxide with monitoring a pH meter. The solution thus obtained was titrated and chelating capability was calculated in the same manner as in Example 1. Results obtained are shown in Table 1.

COMPARATIVE EXAMPLE 6

In a 200 ml beaker were metered and charged 10 ml of a cleaning agent composition prepared in the same manner as in Comparative Example 5, 10 ml of isopropyl alcohol, and water was added thereto to make 100 ml. Then, the solution was adjusted to pH 11 with 10% by weight sodium hydroxide with monitoring a pH meter. The solution thus obtained was titrated and chelating capability was calculated in the same manner as in Example 1. Results obtained are shown in Table 1.

COMPARATIVE EXAMPLE 7

In a 200 ml beaker were metered and charged 10 ml of a cleaning agent composition prepared in the same manner as in Comparative Example 5, 10 ml of isopropyl alcohol, and water was added thereto to make 100 ml. Then, the solution was adjusted to pH 12 with 10% by weight sodium hydroxide with monitoring a pH meter. The solution thus obtained was titrated and chelating capability was calculated in the same manner as in Example 1. Results obtained are shown in Table 1.

COMPARATIVE EXAMPLE 8

In a 200 ml beaker were metered and charged 10 ml of a cleaning agent composition prepared in the same manner as in Comparative Example 5, 10 ml of isopropyl alcohol, and water was added thereto to make 100 ml. Then, the solution was adjusted to pH 13 with 10% by weight sodium hydroxide with monitoring a pH meter. The solution thus obtained was titrated and chelating capability was calculated in the same manner as in Example 1. Results obtained are shown in Table 1.

COMPARATIVE EXAMPLE 9

In a 200 ml beaker were metered and charged 10 ml of a cleaning agent composition prepared in the same manner as in Comparative Example 5, 10 ml of isopropyl alcohol, and water was added thereto to make 100 ml. Then, the solution was adjusted to pH 14 with 10% by weight sodium hydroxide with monitoring a pH meter. The solution thus obtained was titrated and chelating capability was calculated in the same manner as in Example 1. Results obtained are shown in Table 1.

COMPARATIVE EXAMPLE 10

In a 200 ml beaker were metered and charged 10 ml of a cleaning agent composition prepared in the same manner as in Comparative Example 5, 10 ml of isopropyl alcohol, and water was added thereto to make 100 ml. Then, the solution was adjusted to pH 9 with 10% by weight sulfuric acid with monitoring a pH meter. The solution thus obtained was titrated and chelating capability was calculated in the same manner as in Example 1. Results obtained are shown in Table 1.

COMPARATIVE EXAMPLE 11

In a 200 ml beaker were metered and charged 10 ml of a cleaning agent composition prepared in the same manner as in Comparative Example 5, 10 ml of isopropyl alcohol, and water was added thereto to make 100 ml. Then, the solution was adjusted to pH 8 with 10% by weight sulfuric acid with monitoring a pH meter. The solution thus obtained was titrated and chelating capability was calculated in the same manner as in Example 1. Results obtained are shown in Table 1.

COMPARATIVE EXAMPLE 12 TO 18

2.0 g of sodium stearate, reagent grade, as an anionic surfactant and 1.0 g as pure content of sodium tripolyphosphate (hereafter, STPP), reagent grade, were weighed and charged in a 100 ml beaker to which was added 90 ml of water to dissolve the mixture completely. Then, the liquid was transferred in a 100 ml measuring flask and filled up to the indicator line. This was used as a cleaning agent composition. The cleaning agent composition (10 ml) and 10 ml of isopropyl alcohol were charged in a 200 ml beaker and water was added thereto to make 100 ml. Then, the solution was adjusted to pH 10 with 10% by weight sodium hydroxide with monitoring a pH meter. The solution thus obtained was titrated and chelating capability was calculated in the same manner as in Example 1. Results obtained are shown in Table 1. Further, titration was conducted with various pH values in the same manner as in Comparative Examples 6 to 11. Results obtained are shown in Table 1.

COMPARATIVE EXAMPLES 19 TO 25

2.0 g of sodium stearate, reagent grade, as an anionic surfactant and 1.0 g as pure content of zeolite, reagent grade, were weighed and charged in a 100 ml beaker to which was added 90 ml of water to dissolve the mixture completely. Then, the liquid was transferred in a 100 ml measuring flask and filled up to the indicator line. This was used as a cleaning agent composition. The cleaning agent composition (10 ml) and 10 ml of isopropyl alcohol were charged in a 200 ml beaker and water was added thereto to make 100 ml. Then, the solution was adjusted to pH 10 with 10% by weight sodium hydroxide with monitoring a pH meter. The solution thus obtained was titrated and chelating capability was calculated in the same manner as in Example 1. Results obtained are shown in Table 1. Further, titration was conducted with various pH values in the same manner as in Comparative Examples 6 to 11. Results obtained are shown in Table 1.

TABLE 1

Ca-Chelating Capability (as $CaCO_3$)

| | Chelating Agent | | | | |
|---|---|---|---|---|---|
| pH | ASDA (Glycolate) | GLDA (Glycolate) | EDTA-4NA | STPP | Zeolite |
| 8 | 52 | 31 | 265 | 165 | 15 |
| | C. Ex. 2 | C. Ex. 4 | C. Ex. 11 | C. Ex. 18 | C. Ex. 25 |
| 9 | 170 | 160 | 266 | 170 | 18 |
| | Ex. 15 | Ex. 10 | C. Ex. 10 | C. Ex. 17 | C. Ex. 24 |
| 10 | 250 | 250 | 268 | 185 | 22 |
| | Ex. 1 | Ex. 6 | C. Ex. 5 | C. Ex. 12 | C. Ex. 19 |
| 11 | 269 | 277 | 269 | 150 | 26 |
| | Ex. 2 | Ex. 7 | C. Ex. 6 | C. Ex. 13 | C. Ex. 20 |
| 12 | 268 | 274 | 270 | 163 | 32 |
| | Ex. 3 | Ex. 8 | C. Ex. 7 | C. Ex. 14 | C. Ex. 21 |
| 13 | 228 | 230 | 269 | 120 | 25 |
| | Ex. 4 | Ex. 9 | C. Ex. 8 | C. Ex. 15 | C. Ex. 22 |
| 14 | 180 | 165 | 268 | 31 | 18 |
| | C. Ex. 1 | C. Ex. 3 | C. Ex. 9 | C. Ex. 16 | C. Ex. 23 |

ASDA: Sodium aspartate N,N-diacetate
GLDA: Sodium glutamate N,N-diacetate
STPP: Sodium tripolyphosphate

TABLE 2

Composition of Cleaning Agent

| Component | Example 11 | | Example 12 | | Example 13 | | Comparative Example 26 | | Comparative Example 27 | | Comparative Example 28 | |
|---|---|---|---|---|---|---|---|---|---|---|---|---|
| Surfactant | LAS*1 | 15 | LAS*1 | 15 | LAS*1 | 15 | LAS*1 | 15 | LAS*1 | 15 | LAS*1 | 15 |
| Ethyl alcohol | | 5 | | 5 | | 5 | | 5 | | 5 | | 5 |
| Chelating agent and builder | ASDA | 5 | GLDA | 5 | GLDA | 9 | ASDA | 5 | | 0 | GLDA | 5 |
| | GA*2 | 2 | GA*2 | 2 | GA*2 | 2 | GA*2 | 2 | | | | |
| Water | | 78 | | 78 | | 74 | | 76 | | 85 | | 80 |
| pH*3 | | 11 | | 11 | | 11 | | 8 | | 11 | | 11 |

*1: Sodium straight chain alkylbenzenesulfonate
*2: Sodium glycolate
*3: pH was adjusted with sodium hydroxide after the dilution at the time of cleaning test.

Examples 11 to 13 and Comparative Examples 26 to 28

Cleaning agents having the compositions shown in Table 2 were prepared, which were then used to clean the dirtied plates prepared in advance using an improved Leenuts cleaning power tester and their cleaning power against oil dirt were evaluated visually. Results obtained are shown in Table 3. (Appliances were in accordance with JIS K3370).

Preparation of Dirtied Plates

| | Dirt bath |
|---|---|
| Beef fallow | 10 g |
| Soybean oil | 10 g |
| Monoolein | 0.25 g |
| Oil red | 0.1 g |
| Chloroform | 60 ml |

A slide glass for microscope was dipped in the above dirt bath and air dried to prepare a dirtied plate on which the dirt was attached uniformly. There were used only those slide glasses on which the dirt was present in amounts of 0.14 g±0.10 g per slide glass.

Preparation of Cleaning Agent

Cleaning agents having the compositions shown in table 2 were prepared.

Testing Method

Each cleaning agent (1.5 g) was dissolved in water to make 1 liter and adjusted to various pH values with aqueous 10 wt. % sodium hydroxide solution or aqueous 10 wt. % sulfuric acid solution to form cleaning waters. The dirtied plates grouped into sets each consisting of 6 plates were cleaned in an improved Leenuts cleaning power tester with 700 ml of each cleaning water at 30° C. for 3 minutes, rinsed with deionized water at 30° C. for 1 minute, and air-dried. The dirtied plates were observed visually and evaluated by 5 ranks as described below. The average of 6 plates was defined as an index of cleaning power.

5=Nearly colorless and transparent, the dirt mostly disappeared.
4=Has got slightly or partially reddish.
3=Red color was observed clearly but about half as much as the dirt before the cleaning was removed.
2=Dirt was removed in a medium degree between 3 and 2.
1=Dirt was removed only slightly or partially as compared to that before the cleaning and the cleaning effect was low.

Results

TABLE 3

| Dirt plate | Example 11 | Example 12 | Example 13 | Comparative Example 26 | Comparative Example 27 | Comparative Example 28 |
|---|---|---|---|---|---|---|
| 1 | 4 | 4 | 5 | 3 | 3 | 4 |
| 2 | 5 | 4 | 4 | 3 | 3 | 3 |
| 3 | 4 | 4 | 5 | 3 | 3 | 3 |
| 4 | 4 | 5 | 5 | 3 | 4 | 4 |
| 5 | 5 | 4 | 5 | 2 | 3 | 3 |
| 6 | 4 | 4 | 4 | 3 | 3 | 4 |
| Average | 4.3 | 4.2 | 4.7 | 2.8 | 3.2 | 3.5 |

Examples 14 to 16 and Comparative Examples 29 to 31

Using the same cleaning tester and dirtied plates as those used in Example 9, the following cleaning agents were prepared and the same tests as in Example 9 were performed and evaluation was made.

Preparation of Cleaning Agents

TABLE 4

Composition of Cleaning Agent

| Component | Example 14 | | Example 15 | | Example 16 | | Comparative Example 29 | | Comparative Example 30 | | Comparative Example 31 | |
|---|---|---|---|---|---|---|---|---|---|---|---|---|
| Surfactant | LAS | 10 | LAS | 10 | LAS | 10 | LAS | 10 | LAS | 10 | LAS | 10 |
| | EO*1 | 5 | EO*1 | 5 | EO*1 | 5 | EO*1 | 5 | EO*1 | 5 | EO*1 | 5 |
| Ethyl alcohol | | 5 | | 5 | | 5 | | 5 | | 5 | | 5 |
| Chelating agent | ASDA | 5 | GLDA | 5 | GLDA | 9 | ASDA | 5 | | 0 | GLDA | 5 |
| and builder | GA | 2 | GA | 2 | GA | 2 | GA | 2 | | | | |
| Water | | 78 | | 78 | | 74 | | 78 | | 85 | | 80 |
| pH | | 11 | | 11 | | 11 | | 8 | | 11 | | 11 |

*1: Coconut oil reduced alcohol ethylene oxide adduct type nonionic surfactant (commercially available preparation)

Result

TABLE 5

| Dirt plate | Example 14 | Example 15 | Example 16 | Comparative Example 29 | Comparative Example 30 | Comparative Example 31 |
|---|---|---|---|---|---|---|
| 1 | 5 | 4 | 5 | 3 | 4 | 3 |
| 2 | 4 | 5 | 5 | 4 | 4 | 4 |
| 3 | 4 | 4 | 5 | 3 | 3 | 4 |
| 4 | 5 | 5 | 5 | 3 | 3 | 4 |
| 5 | 4 | 4 | 4 | 4 | 4 | 4 |
| 6 | 5 | 4 | 4 | 3 | 3 | 4 |
| Average | 4.5 | 4.3 | 4.7 | 3.3 | 3.5 | 3.8 |

Example 17

The cleaning agent of Example 1 was adjusted with hydrochloric acid to pH 7 and diluted with water to 500 ppm by COD and the resulting solution was subjected to biodegradation treatment in an aerated type activated sludge appliance having 3 small tanks connected serially using sludge of a sewage disposal plant. After conditioning for 1 week, the COD of the treated water was no higher than 50 ppm, and the decomposition rate was no lower than 90%.

Example 18

The cleaning agent of Comparative Example 5 was adjusted to pH 7 with hydrochloric acid and diluted to 500 ppm by COD and the resulting solution was subjected to biodegradation treatment in an aerated type activated sludge appliance having 3 small tanks connected serially using sludge of a sewage disposal plant. After conditioning for 1 week, the COD of the treated water was no higher than 50 ppm, and the decomposition rate was no lower than 90%.

The following are examples of the present invention containing no surfactant.

Test Method 1

Examples 19 to 25 and Comparative Examples 32 to 35 which follow were evaluated by the tests described below. In the tests, 3% of limestone powder and 7% of diatomaceous earth powder were suspended in water with stirring and kept at 50° C. A glass plate of 3 cm×5 cm×1 mm thick and a SUS304 plate having the same size as the glass plate were prepared. Both the types of the plates had formed with a hole of 3 mm in diameter through which a thread for hanging the plate could be passed. Then, the two types of plates were dipped in the suspension for 10 minutes. After 10 minutes, the plates were pulled up slowly and dried in an oven at 110° C. for 3 hours. The plates thus treated were used as artificial dirtied plates for evaluating various cleaning agents in the following examples of the present invention. The evaluation method used was to keep each cleaning agent composition at 60° C. with stirring so that there could occur some flow, and the glass and SUS304 plates were dipped therein for 10 minutes. After 30 minutes, the plates were pulled up slowly and each of the dirtied plates were dipped in and pulled up from three deionized water containing breakers one after another once for each beaker. The plates thus treated were dried in an oven at 110° C. for 3 hours and the cleaning power of the cleaning agent compositions was evaluated by comparing the dirtied plate before and after the cleaning. The evaluation was conducted in two ways, i.e., by measuring glossiness using a glossmeter and by visually evaluating the cleaning conditions of the surface in five ranks. The tests were repeated 3 times for each cleaning agent and an average value was calculated and defined as an evaluation value.

Example 19

A reaction mixture containing 50% by weight of tetrasodium glutamic acid N,N-diacetic acid and 5% by weight of sodium glycolate was obtained from sodium aspartate, sodium cyanide, formalin and sodium hydroxide as raw materials. 100 g of this reaction mixture, 52 g of 48% sodium hydroxide, and 848 g of water were mixed to form a cleaning agent. The cleaning power of the cleaning agent was tested. Result obtained was shown in Table 6. The concentrations of tetrasodium aspartic acid diacetic acid (AD) and sodium glycolate (GA) were determined by liquid chromatography.

Example 20

A reaction mixture containing tetrasodium aspartic acid N,N-diacetic acid and sodium glycolate was obtained from sodium aspartate, sodium monochloroacetate, and sodium hydroxide as raw materials. To this was added tetrasodium aspartate diacetic acid to obtain a solution containing 50% by weight of tetrasodium aspartate diacetic acid and 3% by weight of sodium glycolate. 100 g of this reaction mixture, 52 g of 48% sodium hydroxide, and 848 g of water were mixed to form a cleaning agent. The cleaning power of the cleaning agent was tested. Result obtained was shown in Table 6.

Example 21

A reaction mixture containing 50% by weight of tetrasodium glutamate N,N-diacetic acid and 5% by weight of sodium glycolate was obtained from sodium glutamate, sodium cyanide, formalin and sodium hydroxide as raw materials. 100 g of this reaction mixture, 52 g of 48% sodium hydroxide, and 848 g of water were mixed to form a cleaning agent. The cleaning power of the cleaning agent was tested. Result obtained was shown in Table 6. The concentrations of tetrasodium glutamic acid diacetic acid (GD) and sodium glycolate (G) were determined by liquid chromatography.

Example 22

A reaction mixture containing tetrasodium glutamate diacetic acid and sodium glycolate was obtained from sodium glutamate, sodium monochloroacetate, and sodium hydroxide as raw materials. To this was added tetrasodium aspartate diacetic acid to obtain a solution containing 50% by weight of tetrasodium aspartate diacetic acid and 3% by weight of sodium glycolate. 100 g of this reaction mixture, 52 g of 48% sodium hydroxide, and 848 g of water were mixed to form a cleaning agent. The cleaning power of the cleaning agent was tested. Result obtained was shown in Table 6.

Example 23

To the reaction mixture containing tetrasodium glutamate diacetic acid obtained in Example 19 were freshly added sodium glycolate, the reagent, and water such that the reaction mixture contained 40% by weight of tetrasodium glutamate diacetic acid and 10% by weight of sodium glycolate. 100 g of this reaction mixture, 52 g of 48% sodium hydroxide, and 848 g of water were mixed to form a cleaning agent. The cleaning power of the cleaning agent was tested. Result obtained was shown in Table 6.

Example 24

A reaction mixture containing 50% by weight of tetrasodium glutamate diacetic acid and 15% by weight of sodium glycolate was obtained from sodium glutamate, sodium monochloroacetate, and sodium hydroxide as raw materials. 50 g of this reaction mixture, 52 g of 48% sodium hydroxide, and 898 g of water were mixed to form a cleaning agent. The cleaning power of the cleaning agent was tested. Result obtained was shown in Table 6.

Example 25

100 g of the reaction mixture containing tetrasodium glutamate diacetic acid, 52 g of 48% sodium hydroxide, 5 g of sodium gluconate (G), the reagent, and 843 g of water were mixed to form a cleaning agent. The cleaning power of the cleaning agent was tested. Result obtained was shown in Table 6.

Comparative Example 32

50 g of tetrasodium EDTA, the reagent, 52 g of 48% sodium hydroxide, and 898 g of water were mixed to form a cleaning agent. The cleaning power of the cleaning agent was tested. Result obtained was shown in Table 6.

Comparative Example 33

The reaction mixture of Example 19 was adjusted to pH 2 with hydrochloric acid, and methanol was dripped down therein to precipitate solids of glutamic acid diacetic acid. The solids were filtered and resdissolved in water. To this was dripped methanol to precipitate solids. The solids were dried in an vacuum drier at 60° C. for 5 hours. The dried solids were dissolved in some water and adjusted to pH 13 with 48% sodium hydroxide. Further addition of water gave an aqueous 50% by weight tetrasodium aspartate diacetic acid. This solution contained sodium glycolate in an amount of no higher than 0.1% by weight, which content could not be detected by liquid chromatographic analysis. 100 g of this solution, 52 g of 48% sodium hydroxide, and 898 g of water were mixed to form a cleaning agent. The cleaning power of the cleaning agent was determined. Result obtained was shown in Table 6.

Comparative Example 34

The reaction mixture of Example 21 was adjusted to pH 2 with hydrochloric acid, and methanol was dripped down therein to precipitate solids of glutamic acid diacetic acid. The solids were filtered and redissolved in water. To this was dripped methanol to precipitate solids. The solids were dried in an vacuum drier at 60° C. for 5 hours. The dried solids were dissolved in some water and adjusted to pH 13 with 48% sodium hydroxide. Further addition of water gave an aqueous 50% by weight tetrasodium glutamate diacetic acid. This solution contained sodium glycolate in an amount of no higher than 0.1% by weight, which content could not be detected by liquid chromatographic analysis. 100 g of this solution, 52 g of 48% sodium hydroxide, and 898 g of water were mixed to form a cleaning agent. The cleaning power of the cleaning agent was determined. Result obtained was shown in Table 6.

Comparative Example 35

52 g of 48% sodium hydroxide and 948 g of water were mixed to form a cleaning agent. The cleaning power of the cleaning agent was determined. Result obtained was shown in Table 6.

TABLE 6

| | Cleaning Agent | | | | Cleaning Efficiency | | | |
|---|---|---|---|---|---|---|---|---|
| | Composition | | | | Evaluation of Glossiness (%) | | Visual Observation | |
| | NaOH (wt. %) | ASDA, GLDA, and others (wt. %) | | GA/ADA (wt. ratio) | Glass plate | SUS plate | Glass plate | SUS plate |
| Example 19 | 5 | AD | 5 | 0.1 | 95 | 95 | 5 | 5 |
| Example 20 | 5 | AD | 5 | 0.06 | 94 | 95 | 5 | 5 |
| Example 21 | 5 | GD | 5 | 0.1 | 95 | 96 | 5 | 5 |
| Example 22 | 5 | GD | 5 | 0.06 | 94 | 95 | 5 | 5 |
| Example 23 | 5 | GD | 4 | 0.25 | 93 | 95 | 5 | 5 |
| Example 24 | 5 | GD | 2.5 | 0.3 | 91 | 93 | 4 | 4 |
| Example 25 | 5 | GD<br>G | 5<br>0.5 | 0.1 | 95 | 97 | 5 | 5 |
| Comparative Example 32 | 5 | —<br>EDTA | 5 | — | 95 | 97 | 5 | 5 |
| Comparative Example 33 | 5 | AD | 2.5 | — | 73 | 70 | 3 | 3 |
| Comparative Example 34 | 5 | GD | 2.5 | — | 71 | 73 | 3 | 3 |
| Comparative Example 35 | 5 | — | | — | 18 | 32 | 1 | 2 |

ASDA: tetrasodium aspartic acid diacetic acid
GLDA: tetrasodium glutamic acid diacetic acid
ADA: tetrasodium aminodicarboxylic acid N,N-diacetic acid (ASDA or GLDA)
GA: sodium glycolate
G: sodium gluconate
EDTA: tetrasodium EDTA
The standard of evaluation by visually observation is same as described at table 3.

Example 26

The cleaning agent prepared in Example 19 was diluted with water to 0.05% by COD and the diluted solution was fed to an aerated type activated sludge appliance having 2 small tanks connected in series using sludge from an activated sludge treatment appliance which treats sewage from chemical industries in order to conduct biodegradation tests. The COD in the sewage decreased to about 0.015 to 0.01%, giving decomposition rate of 70 to 80%.

Example 27

The cleaning agent prepared in Example 21 was diluted with water to 0.05% by COD and the diluted solution was fed to an aerated type activated sludge appliance having 2 small tanks connected in series using sludge from an activated sludge treatment appliance which treats sewage from chemical industries in order to conduct biodegradation tests. The COD in the sewage decreased to about 0.015 to 0.01%, giving decomposition rate of 70 to 80%.

INDUSTRIAL APPLICABILITY

Cleaning compositions containing as major components A) aminodicarboxylic and N,N-diacetic acid salts (particularly, salts of aspartic acid N,N-diacetic acid or glutamic acid N,N-diacetic acid) and B) glycolic acid salt exhibit excellent cleaning effects particularly when the pH of the cleaning liquid is adjusted to 8.5 or higher, have biodegradability, and can be used advantageously as domestic, medical, and industrial cleaning agents. In particular, the compositions containing, in addition to the above described A) and B), C) anionic surfactant and/or nonionic surfactant or D) alkali metal hydroxide are useful as cleaning agent composition.

What is claimed is:

1. A cleaning agent composition comprising A) an aminodicarboxylic acid N,N-diacetic acid salt represented by the following formula (I)

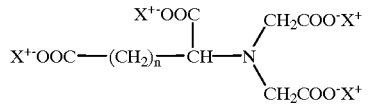

(I)

wherein each $X^+$ is independently selected from the group consisting of an alkali metal ion and an ammonium ion, and n is an integer of from 2 to 5, and B) a glycolic acid salt.

2. The cleaning agent composition as claimed in claim 1, wherein the composition contains 0.01 to 0.6 parts by weight of a glycolic acid salt per 1 part by weight of the aminodicarboxylic acid N,N diacetic acid salt.

3. The cleaning agent composition as claimed in claim 2, wherein the composition has a pH of 8.5 of higher.

4. The cleaning agent composition as claimed in claim 3, wherein the composition further contains C) an anionic surfactant and/or nonionic surfactant and has a pH of 8.5 to 13.

5. The cleaning agent composition as claimed in claim 4, wherein the composition contains 1 to 100 parts by weight of the anionic surfactant and/or nonionic surfactant per 1 part by weight of aminodicarboxylic acid N,N-diacetic acid salt.

6. A soap, comprising the cleaning agent composition as claimed in any one of claims 1 to 5.

7. A method for cleaning a cloth, comprising treating said cloth with a detergent comprising the cleaning agent composition as claimed in any one of claims 1 to 5.

8. A method for cleaning a house, comprising treating said house with a detergent comprising the cleaning agent composition as claimed in any one of claims 1 to 5.

9. A method for cleaning a kitchen, comprising treating said kitchen with a detergent comprising the cleaning agent composition as claimed in any one of claims 1 to 5.

10. A method for cleaning a toilet, comprising treating said toilet with a detergent comprising the cleaning agent composition as claimed in any one of claims 1 to 5.

11. A method for cleaning a bathroom, comprising treating said bathroom with a detergent comprising the cleaning agent composition as claimed in any one of claims 1 to 5.

12. A method for cleaning a bathtub, comprising treating said bathtub with a detergent comprising the cleaning agent composition as claimed in any one of claims 1 to 5.

13. A method for cleaning glass, comprising treating said glass with a detergent comprising the cleaning agent composition as claimed in any one of claims 1 to 5.

14. A method for cleaning an automobile, comprising treating said automobile with a detergent comprising the cleaning agent composition as claimed in any one of claims 1 to 5.

* * * * *